430-903
9/15/86 XR 4,612,273 SR

United States Patent [19]
Westdale et al.

[11] Patent Number: 4,612,273
[45] Date of Patent: Sep. 16, 1986

[54] PRESSURE FIXING A SINGLE COMPONENT TONER WITH POLYAMIDE-ROSIN

[75] Inventors: Virgil W. Westdale, Barrington; James L. Hanrahan, Mt. Prospect, both of Ill.

[73] Assignee: AM International, Inc., Chicago, Ill.

[21] Appl. No.: 717,657

[22] Filed: Mar. 29, 1985

[51] Int. Cl.[4] ..... G03G 13/20
[52] U.S. Cl. ..... 430/98; 430/106.6; 430/109; 430/111; 430/903
[58] Field of Search ..... 430/98, 106.6, 109, 430/903, 111

[56] References Cited

U.S. PATENT DOCUMENTS

T875,005 6/1970 Beyer et al. ..... 430/106.6
3,873,325 3/1975 Westdale ..... 430/98
4,256,818 3/1981 Blossey et al. ..... 430/106.6 X
4,430,403 2/1984 Westdale et al. ..... 430/106.6 X
4,430,407 2/1984 Westdale ..... 430/903 X
4,430,413 2/1984 Westdale et al. ..... 430/903 X

*Primary Examiner*—Roland E. Martin
*Attorney, Agent, or Firm*—Nicholas A. Camasto; Donald C. Kolasch

[57] ABSTRACT

A pressure fixable single component electrophotographic toner or developer composition of a particle size of from 10–40 microns comprising a specialized low melt viscosity polyamide resin composition and a magnetic oxide component. Highly conductive carbon may be added to control the resistivity of the developer particles. The developer comprises from 65-50 percent of the magnetic oxide component and from 35–50 percent of the polyamide resinous component.

3 Claims, 1 Drawing Figure

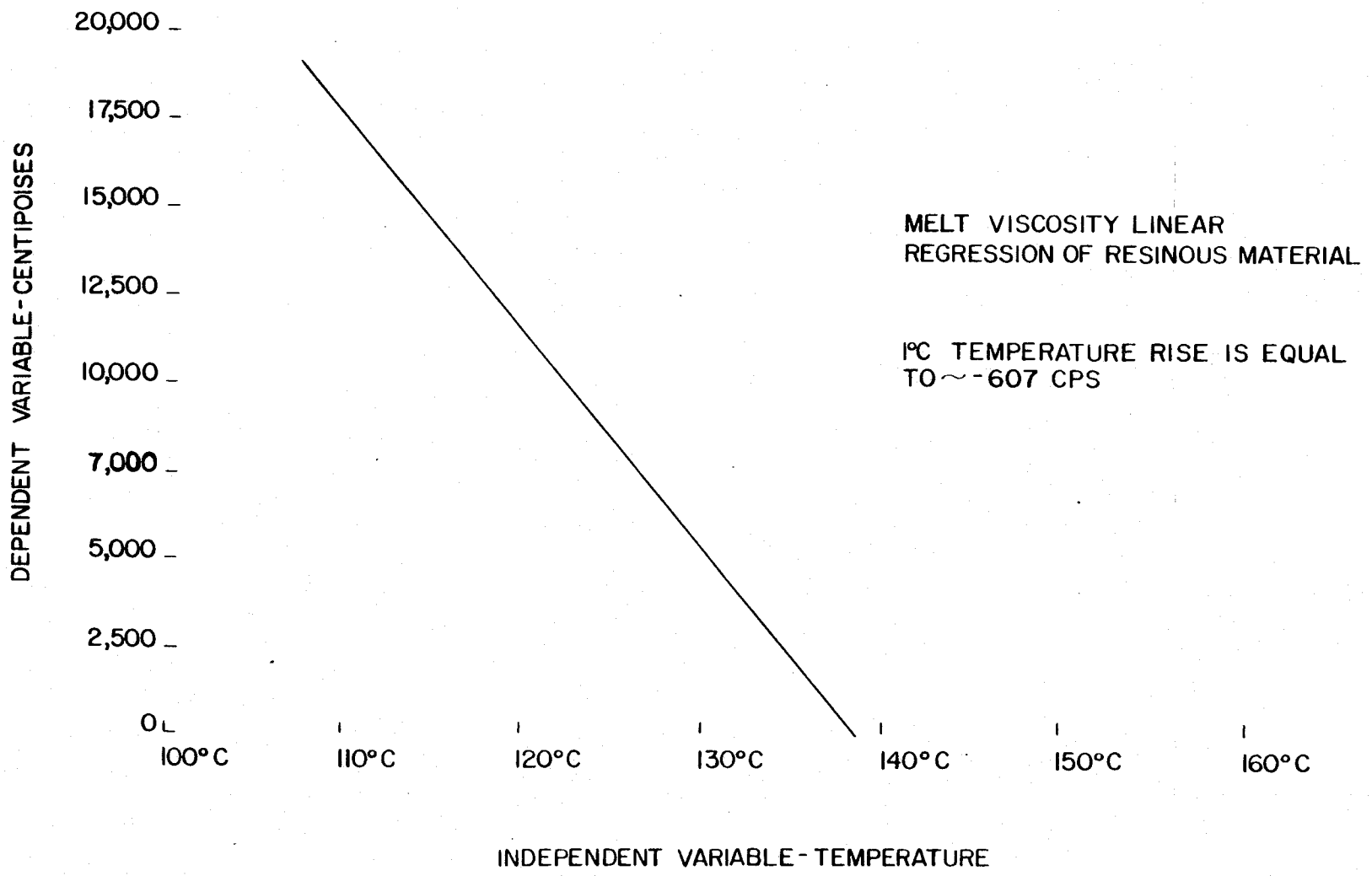
MELT VISCOSITY LINEAR
REGRESSION OF RESINOUS MATERIAL
1°C TEMPERATURE RISE IS EQUAL
TO ~ -607 CPS
20,000
17,500
15,000
12,500
10,000
7,000
5,000
2,500
0
100°C
110°C
120°C
130°C
140°C
150°C
160°C
DEPENDENT VARIABLE-CENTIPOISES
INDEPENDENT VARIABLE-TEMPERATURE

PRESSURE FIXING A SINGLE COMPONENT TONER WITH POLYAMIDE-ROSIN

BACKGROUND OF THE INVENTION

The present invention relates to toner powder for use in electrophotography, and more specifically, to a pressure fusible toner composition used for the development of electrostatic latent images such as those formed on an insulating or photoconductive insulating surface in the electrophotographic imaging arts.

In electrophotographic printing, generally a uniform electrostatic charge is applied to a photoconductive insulating layer and the resulting charged surface selectively exposed to electromagnetic radiation so a to dissipate the charge in those areas exposed to the radiation, thereby producing an electrostatic latent image. The resulting latent image is subsequently developed by depositing a finely divided electroscopic developer material, referred to as toner, on the electrostatically formed image. Generally speaking, the charged toner particles will have a charge opposite to the residual electrostatic charge image so that the toner particles adhere to the charged areas to form a visible image. This image may be fixed in situ on the support or transferred to a secondary support surface and the transferred image permanently affixed to the secondary support surface.

Two component developer mixtures are conventionally used to develop electrostatic latent images, comprising a pigmented resinous toner powder and a carrier component wherein the carrier component is substantially larger in size than its toner complement. The toner particles, which are generally made of a fine pigmented resinous material, are charged triboelectrically by rubbing against the carrier particles causing them to adhere electrostatically. The composition of the developer mix is chosen such that the toner particles will acquire an electrostatic charge of a polarity opposite to that of the electrostatic image to be developed. As a result, when the developer is brought into contact with the electrostatic latent image, the toner particles are attracted from the carrier particles and selectively deposited onto the electrostatic image by the electrostatic charge of the image. The powder or toner image that is obtained is either fixed in situ on the surface of the image-bearing substrate or the powder image selectively transferred to a receiving surface to which it is then fixed. The fixing process can reflect any one of several approaches such as pressure fixing, vapor fixing or heat fusing, depending upon the specifics of the particular system. In another form of development utilizing a developer mix comprising a carrier and toner component, a developer composition containing toner and magnetic carrier particles is transported by a magnet. The resulting magnetic field causes alignment of the magnetic carrier into a brush-like configuration. This magnetic brush is engaged with the electrostatic image-bearing surface, and the toner particles supported on the brush-like configuration are drawn from the "brush" to the latent image by electrostatic attraction. Thus, a developer mixture may be provided comprising a toner material and a carrier material which consists of particles which are magnetically attractable. Such a configuration is generally referred to as a magnetic brush development system.

Although the above development systems have been found useful in electrophotography, they are not without their disadvantages. For example, in the use of a developer mix comprising both the toner and carrier components, in combination with a heat-fusible image fixing system, mix fatigue is encountered which generally results in poor copy images and the masters produced therefrom have relatively short periods of usage time. The carrier component slowly is reduced in size and becomes increasingly coated with toner, producing a resulting change in the triboelectric charge relationship, thus leading to a lower quality image. Furthermore, in the reproduction of high-contrast copies utilizing the powder-carrier developer mix wherein the mutual electrification of the components is governed by the distance between their relative positions in the triboelectric series, when otherwise compatible electroscopic powder and carrier materials are removed from each other in the triboelectric series by two great a distance, the resulting images are very faint because the attractive forces between the carrier and toner particles compete with the attractive forces between the electrostatic latent image and the toner particles. It is, therefore, readily apparent that many materials which otherwise have suitable properties for employment as carrier particles are unsuitable because they possess unsatisfactory triboelectric properties. In addition, uniform triboelectric surface characteristics of many carrier surfaces are difficult to achieve with mass production techniques.

Heretofore, a single component toner material has been provided for use in combination with heat and pressure-fusing systems which eliminates the need for the presence of the carrier component, with a certain degree of success, since the toner, as a result of its formulation, including a magnetic component, serves as its own carrier and, thus, is useful in the development of electrostatic latent images in electrophotography. However, it would be desirable to eliminate the need for heat in order to conserve energy.

SUMMARY OF THE INVENTION

Therefore, it is an object of the present invention to provide an electrophotographic imaging system which will provide an improved developer.

It is a further object of the present invention to provide an improved developer composition for use in an electrophotographic imaging process which eliminates the conventionally used carrier component.

Another object of the present invention is to provide a single component developer composition.

Yet, a further object of the present invention is to provide a single component developer composition useful in electrophotography, wherein the resulting developed image is fixed by pressure, in the absence of heat.

Still a further object of the present invention is to provide a single component toner composition suitable for use in electrophotographic imaging having unexpected pressure fixing qualities.

The foregoing objects and others are accomplished in accordance with the present invention, generally speaking, by providing a single component developer composition, hereinafter referred to as a developer toner, for developing electrostatic images, comprising a resinous component having a sharp melt point and low melt viscosity and, further, having or exhibiting good cold-flow characteristics, inclusive of good wetting properties under pressure. For purposes of the present invention, the specific polyamide resin composition was determined to be highly suitable for use as the single component toner resinous component due to its sharp melting point characteristics and low melt viscosity. Included as a component of the polyamide toner composition is a magnetic oxide material, so that the final composition comprises from 35-50 percent resin composition to 65-50 percent magnetic oxide. Below 35 percent resin, the adhesiveness of the toner will begin to deteriorate. The particle size of the resulting developer or toner particles of the present invention will range from a 10 micron absolute minimum to a 40 micron maximum resulting in less background, lower light exposure settings, better powder flow characteristics, less toner dust in the image development area and less tendency for the particles to spray over defined image edges, particularly around large solid areas. The resulting polyamide-magnetic oxide toner composition possesses excellent cold-flow characteristics under pressure to exhibit unexpected pressure fixing characteristics. Since the subject resins have good cold-flow characteristics, they inherently possess the capability to desirably wet-out the magnetic oxide particles in the formulation. This wetting-out characteristic and relatively good cold-flow property of the toner is also attributed to the presence of the specified amount of magnetic oxide since the magnetic oxide has good dispersing characteristics, and plays an important role in the cold-flow mechanism. The developer toner further preferably includes a highly conductive carbon pigment to control the conductivity of the resulting toner particle.

It has been determined in the course of the present invention that a single component developer composition or toner comprising a specific polyamide resin composition and a magnetic oxide additive exhibits the necessary characteristics which permit the toner to be used in a pressure-fusing system of an electrophotographic imaging process, eliminating the requirement for externally applied heat. The utilization of the polyamide resin composition of the present invention will permit the formulation of a single-component toner with a magnetic oxide content ranging from 50 to 65 percent by weight. The toner particle size will range from a 10 micron absolute minimum to a 40 micron absolute maximum. The pressure-fusible toners of the present invention are especially suitable for fabricating masters subsequently used for duplicating. The specific polyamide resinous composition of the present invention exhibits the required sharp melting point and low melt viscosity and corresponding necessary cold-flow characteristic, when used in combination with the magnetic oxide component, in the amount prescribed and per the designated particle size, to provide the pressure fusible toner.

BRIEF DESCRIPTION OF THE DRAWING

FIG. 1 represents a graphic representation of the melt viscosity linear regression of the resinous component of the developer of the present invention.

DETAILED DESCRIPTION OF THE INVENTION

In accordance with the present invention, a developer powder or toner is provided comprising at least 50 percent magnetic oxide and the balance a polyamide resin composition including an amide resin having a sharp melting point within the range of about 70° to 165° C., preferably within the range of from about 97° to 107° C., with a low melt viscosity. As used herein, the term polyamide resin refers to the polymerization product resulting from the condensation of polyamines with polybasic acids. The polyamide resin composition utilized is a specific blend of a low melt viscosity polyamide resin having a melting point within the above-stated range of from 70° to 165° and a polyamide-rosin blend in an amount of from about 25-35 percent of the amide-rosin blend and 76-65 percent of the polyamide resin. The polyamide-rosin blend is commercially available from Lawter International, Inc. This specific composition exhibits the desired properties to produce a pressure fixable toner.

A highly conductive carbon pigment is added to the developer powder or toner in order to provide the particles with a surface coating which will render them somewhat conductive, so as to decrease the resistivity of the particle, and enhance powder flow processing. Other pigment materials may be used in combination with the conductive carbon pigment in order to produce various desired effects. The carbon particles will generally have a size ranging from 12.0 to 22.0 millimicrons and will be added to the toner composition in an amount from about 0.5 to 4.0 percent, preferably 0.75 to 1.2 percent by weight based on the total weight of the toner. The conductive carbon is added to the toner or developer composition to impart thereto a resistivity ranging from 150 ohm/cm - $3\times10^5$ ohm/cm, and preferably $3\times10^2$ ohm/cm to $3\times10^3$ ohm/cm, to achieve the desired conductivity. Typical highly conductive carbon particles suitable for use in the present invention include Columbian CC-40-220 commercially available from the Columbian Chemicals Co., Vulcan XC-72R commercially available from Cabot Corp. and Corax L commercially available from the Degussa Corp. The resulting developer composition is classified to eliminate excess carbon.

Any suitable magnetic oxide component may be added to the resinous toner composition which imparts the desired effect to the single-component developer of the present invention. Typical magnetic oxide materials includes $Fe_2O_3$, $Fe_3O_4$, and various forms of magnetite. The magnetic oxide component is present in the toner composition in an amount ranging from about 50 to 65 percent by weight, and preferably from about 55 to 60 percent, in order to achieve effective development and wetting properties. In such formulations, the amount of the polyamide resinous composition present will range respectively from about 50 to 35 percent by weight, and preferably 45 to 40 percent.

The particle size system of the resulting developer or toner particles of the present invention will comprise a 10 micron absolute minimum to a 40 micron maximum resulting in less background, lower light exposure settings, better powder flow characteristics, less toner dust in the image development area and less tendency for the particles to spray over defined image edges, particularly around large solid areas.

Any suitable technique may be used in order to prepare the developer composition or toner of the present invention. The polyamide resin composition may be mixed thoroughly with the magnetic oxide particles which have been previously reduced to the desired particle size. The resulting mixture is heated to about 180° to 200° C. to melt the polyamide resin composition and form a homogeneous melt which is blended and then allowed to cool and harden. At this point, the magnetic substance has been distributed thoroughly and uniformly throughout the resin composition. The cold, hardened mix is then broken up and ground to reduce the material to a particle size of from 10 to 40 microns. Much higher quality images are produced with a particle size range of from 10-40 microns as opposed to a system, for example, incorporating a range of from 6 to 30 microns. The minimum size is the primary difference between the two systems. If the magnetic flux of the particles are considered equivalent, then the magnetic force on a particle is proportional to the volume:

$$V = \frac{4\pi r^3}{3}$$

where,

V = volume of a sphere (particle)

$\pi = 3.1416$ r = radius of particle

The volume for a 10 micron absolute minimum particle size is about 523 cubic microns, while the volume of a 5 micron absolute minimum particle size is about 65 cubic microns. Thus, the force on the 10 micron particle is about 8 times that of the 5 micron particle, disregarding any other external influence.

As seen from FIG. 1, the melt viscosity of the polyamide resinous composition of the present invention, as expressed in centipoises (cps), is unexpectedly low in relationship to temperature, and drops off sharply with increased temperature. A 1° C. temperature rise is equal to approximately a negative 607 cps. The resinous components of the conventional toner compositions have a much higher melt viscosity at the corresponding temperatures of the illustration such that they require the application of heat from an external source to realize the necessary flow properties to successfully fuse the toner. The resinous component of the present invention presents good wetting properties at low temperatures, thus providing for fusing of the toner upon application of pressure alone.

PREFERRED EMBODIMENTS

To further define the specifics of the present invention, the following examples are intended to illustrate and not limit the particulars of the present system. Parts and percentages are by weight unless otherwise indicated. The examples are also intended to illustrate various preferred embodiments of the present invention.

EXAMPLE I

A toner consisting of 500 parts of a polyamide resin composition comprising 10 parts of a P-1084 polyamide resin-rosin and 25 parts of a P-4771 polyamide resin, both available from Lawter International Inc., and a blend of 115 parts of $Fe_3O_4$ (magnetic oxide MO-8029 commercially available from Pfizer, Inc.) and 385 parts of $Fe_3O_4$ (magnetic oxide MPB Standard D commerically available from Indiana General) is prepared according to conventional melt blend techniques and the resulting particles size-classified to obtain a toner having a volume particle size of from 10 to 40 microns. Conductive carbon pigment is added to the toner up to about 1 percent to enhance the powder flow properties.

An electrostatic latent image is formed on the surface of a zinc oxide substrate, by conventional electrophotographic techniques and developed using the above toner. The developed image is fixed to the substrate by applying a pressure of about 100 lbs./linear inch between steel rolls.

EXAMPLE II

The process of Example I is repeated with the exception that 450 parts of the polyamide resin blend are mixed with 550 parts of the magnetic oxide ($Fe_3O_4$) blend (125 parts of the MO-8029 and 425 parts of MPB Standard D). The toner particles are classified to a particle size of from 12 to 35 microns. The developed toner image is pressure fixed to the coated photoconductive master, as above in Example I.

The developer material of the present invention with its pressure fixing properties is particularly suitable for use in combination with photoconductive members of the coated variety, such as zinc oxide paper, and the electrostatic image formed by conventional techniques is developed and the toner image pressure fused to the substrate.

Although the present examples are specific in terms of conditions and materials used, any of the above typical materials may be substituted where suitable in the examples with similar results.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed:

1. An electrophotographic imaging process comprising:

forming an electrostatic latent image on the surface of a photoconductive insulating layer, developing said latent image with a single component toner composition consisting essentially of a polyamide resin composition consisting of from 65-75 percent of a low melt viscosity polyamide resin having a melting point within the range of from about 70° to 165° C. and from 35-25 percent of a polyamide-rosin component, and a magnetic oxide component, said polyamide resin composition being present in an amount of from 35 to 50 percent of said developer and said magnetic oxide component being present in an amount of from 65-50 percent of said developer, said developer having a particle size of from 10-40 microns with the capacity to develop an electrostatic latent image to form a toner image which is pressure fixable in the absence of heat, and pressure fusing said toner in an imagewise configuration to said photoconductive insulating layer in the absence of heat.

2. The imaging process of claim 1, wherein said photoconductive insulating layer is zinc oxide paper.

3. The imaging process of claim 1, wherein said toner is transferred after the development step, in imagewise configuration, to a coated paper to which it is pressure fixable in the absence of heat.

* * * * *